US009939187B2

(12) United States Patent
Lee et al.

(10) Patent No.: US 9,939,187 B2
(45) Date of Patent: Apr. 10, 2018

(54) REFRIGERATOR

(71) Applicant: LG ELECTRONICS INC., Seoul (KR)

(72) Inventors: Donghoon Lee, Seoul (KR); Wookyong Lee, Seoul (KR); Bongjin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/027,158

(22) PCT Filed: Oct. 2, 2014

(86) PCT No.: PCT/KR2014/009338
§ 371 (c)(1),
(2) Date: Apr. 7, 2017

(87) PCT Pub. No.: WO2015/050404
PCT Pub. Date: Apr. 9, 2015

(65) Prior Publication Data

US 2017/0211865 A1 Jul. 27, 2017

(30) Foreign Application Priority Data

Oct. 4, 2013 (KR) ..... 10-2013-0118460
Oct. 4, 2013 (KR) ..... 10-2013-0118535
Oct. 4, 2013 (KR) ..... 10-2013-0118536

(51) Int. Cl.
*F25C 5/00* (2006.01)

(52) U.S. Cl.
CPC ..... *F25C 5/005* (2013.01); *F25C 2400/04* (2013.01); *F25C 2400/10* (2013.01);
(Continued)

(58) Field of Classification Search
CPC .. F25C 5/005; F25C 2500/08; F25C 2400/04; F25C 2400/10; F25C 2500/02; F25D 2400/04
See application file for complete search history.

(56) References Cited

U.S. PATENT DOCUMENTS 7,065,975 B1 6/2006 Herndon
7,426,838 B1 9/2008 Shapiro et al.
(Continued)

FOREIGN PATENT DOCUMENTS

CN 102589230 7/2012
CN 102997536 3/2013
(Continued)

OTHER PUBLICATIONS

Extended European Search Report in European Application No. 14850680.1, dated Mar. 30, 2017, 8 pages. (with English translation).

(Continued)

*Primary Examiner* — Emmanuel Duke
(74) *Attorney, Agent, or Firm* — Fish & Richardson P.C.

(57) ABSTRACT

A refrigerator comprises: a cabinet including a refrigerator compartment, and a freezer compartment provided; a refrigerator compartment door rotationally connected to the front side of the cabinet to open/close the refrigerator compartment; an ice bank which is provided to the ice compartment and stores ice; an icemaker which comprises an upper tray forming a hemispherical upper cell, a lower tray forming a hemispherical lower cell, and a rotating shaft for rotating the lower tray, and which is provided in the freezer compartment; and an ice transfer device for transferring the ice collected in the ice collector to the ice bank along the ice transfer duct, wherein the ice transfer device can include: a transfer cable; a pusher connected to an end of the transfer
(Continued)

cable; and a transfer case for accommodating the transfer cable which is wound.

14 Claims, 14 Drawing Sheets

(52) U.S. Cl.
CPC ..... *F25C 2500/02* (2013.01); *F25C 2500/08* (2013.01); *F25D 2400/04* (2013.01)

(56) References Cited

U.S. PATENT DOCUMENTS

| | | | | |
|---|---|---|---|---|
| 8,925,342 | B2 | 1/2015 | Son | |
| 2006/0283202 | A1 | 12/2006 | Oh et al. | |
| 2009/0145158 | A1* | 6/2009 | Anselmino | F25C 5/005 62/344 |
| 2009/0193832 | A1* | 8/2009 | Lee | F25C 5/005 62/344 |
| 2012/0024001 | A1* | 2/2012 | Oh | F25C 5/005 62/344 |
| 2012/0174613 | A1 | 7/2012 | Park | |
| 2013/0061626 | A1 | 3/2013 | Son | |
| 2013/0067947 | A1* | 3/2013 | Son | F25C 5/005 62/379 |

FOREIGN PATENT DOCUMENTS

| | | |
|---|---|---|
| CN | 102997587 | 3/2013 |
| EP | 2315018 | 4/2011 |
| JP | S6099976 | 6/1985 |
| JP | 2004028439 | 1/2004 |
| JP | 2010112676 | 5/2010 |
| KR | 10-2011-0037609 | 4/2011 |
| KR | 10-2012-0080722 A1 | 7/2012 |
| KR | 10-2013-0028324 A1 | 3/2013 |
| KR | 10-2013-0029924 A1 | 3/2013 |
| WO | 9313413 | 7/1993 |

OTHER PUBLICATIONS

International Search Report dated Jan. 27, 2015 for Application No. PCT/KR2014/009338, 4 pages.

* cited by examiner

[Fig. 1]
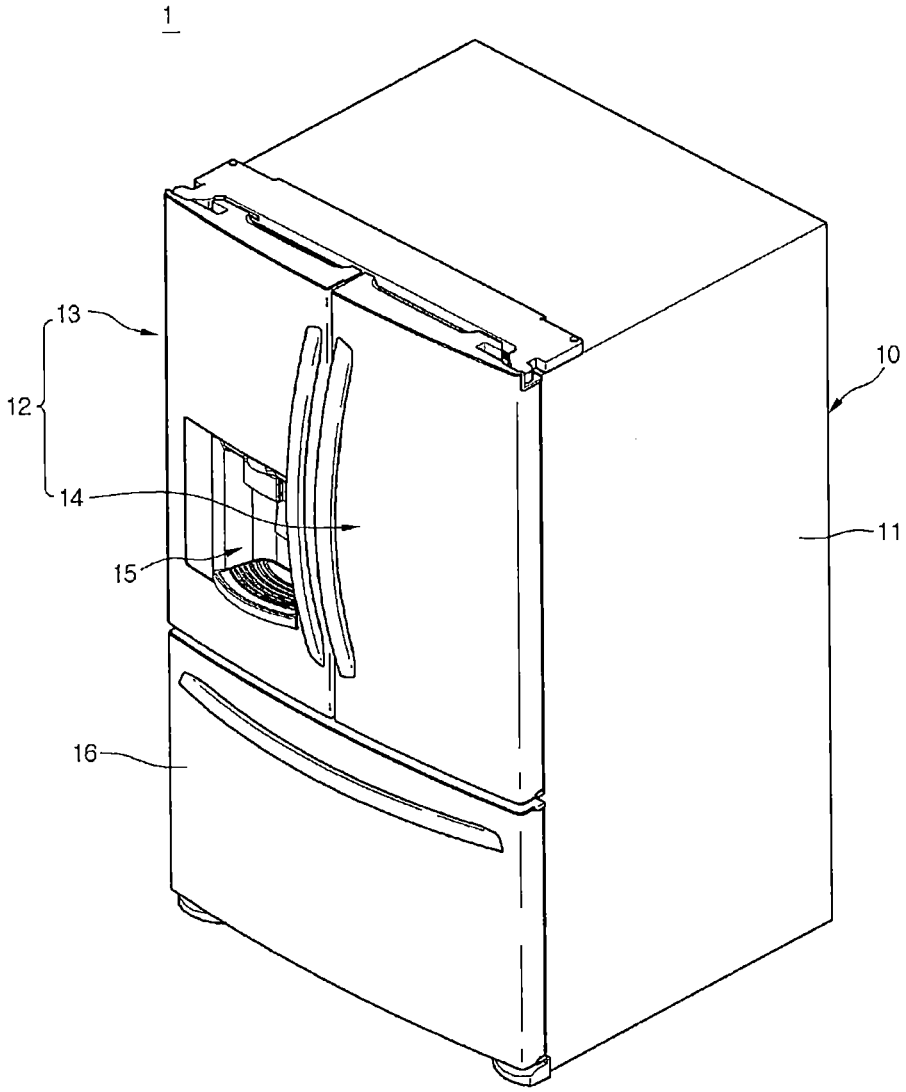

[Fig. 2]
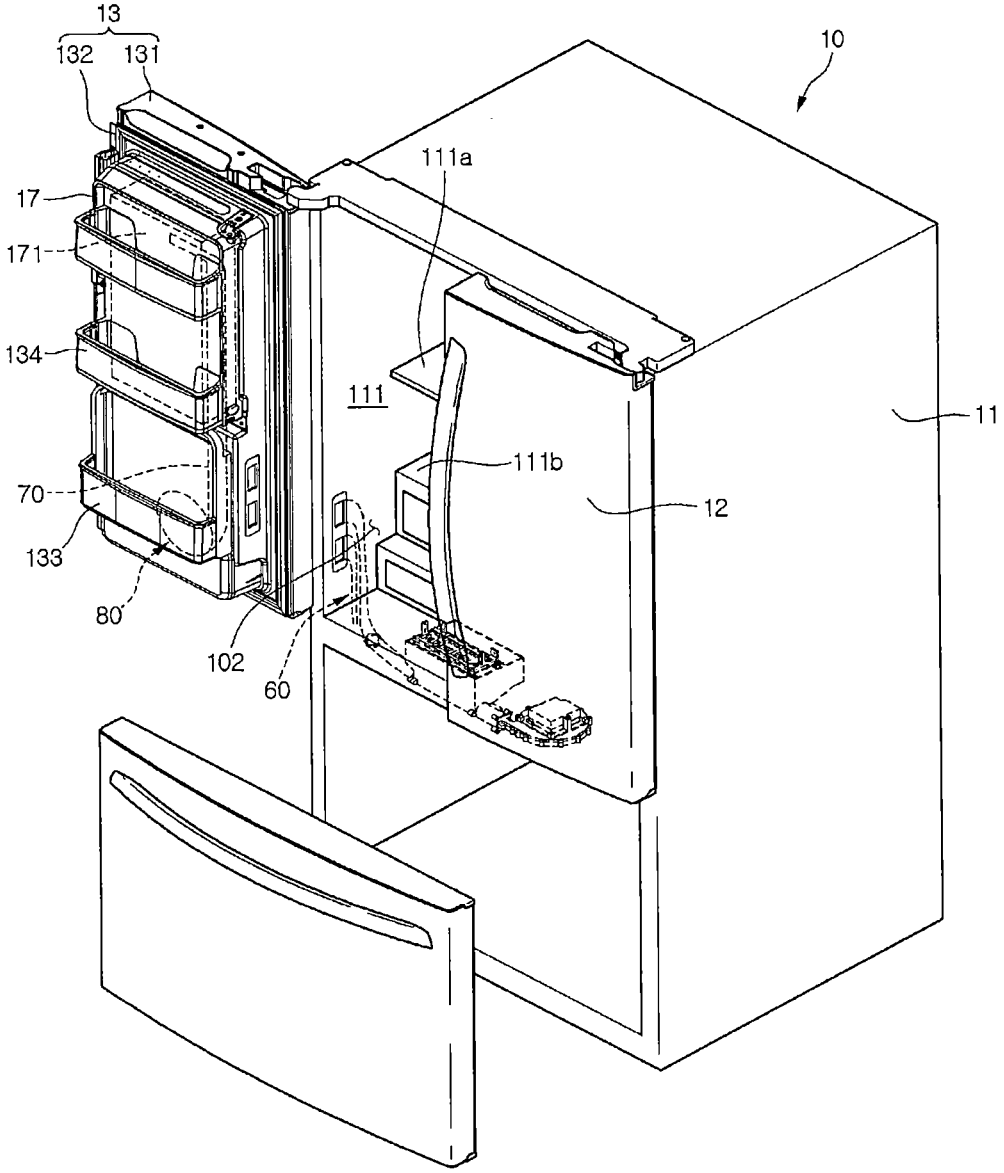

[Fig. 3]
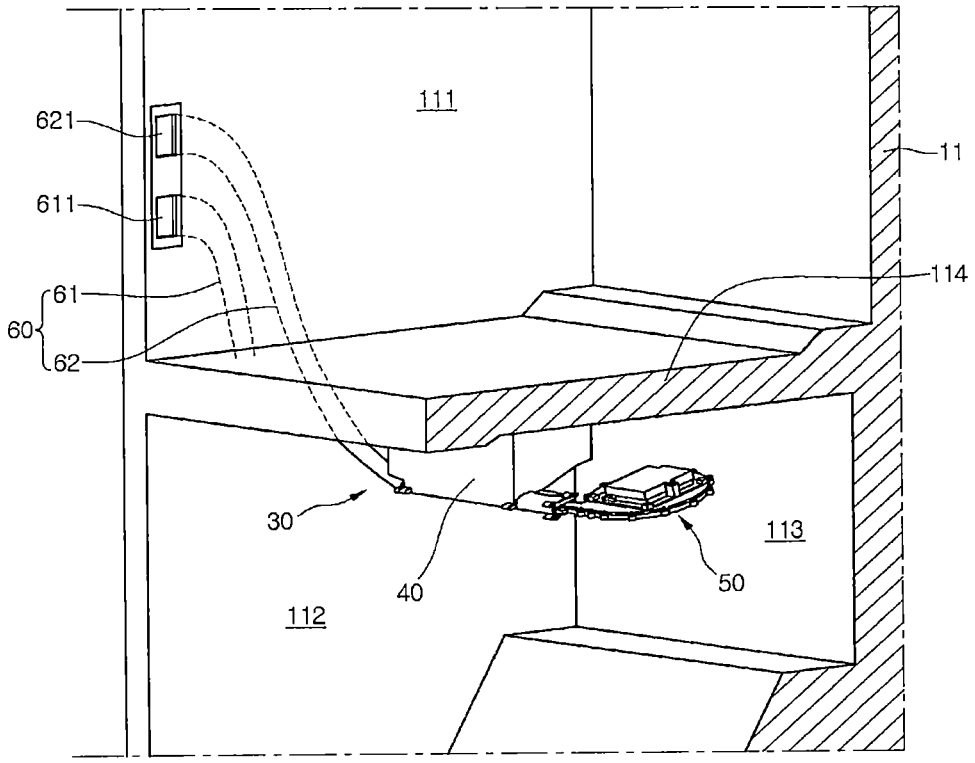
[Fig. 4]
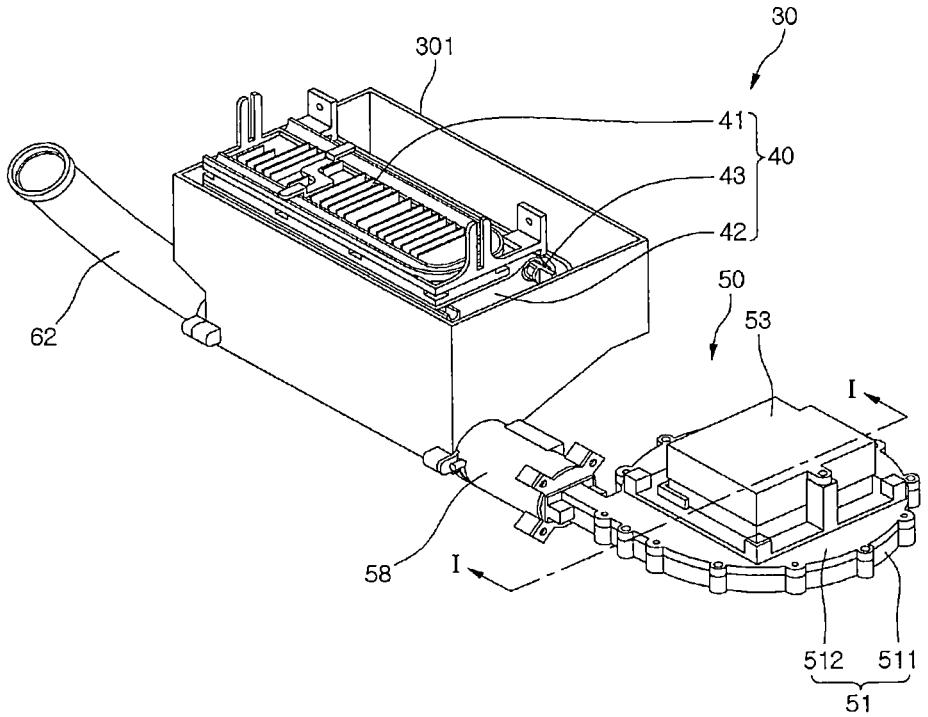

[Fig. 5]
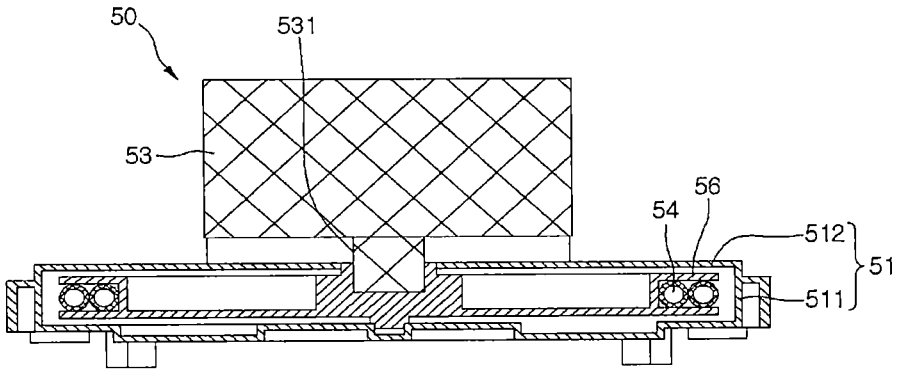
[Fig. 6]
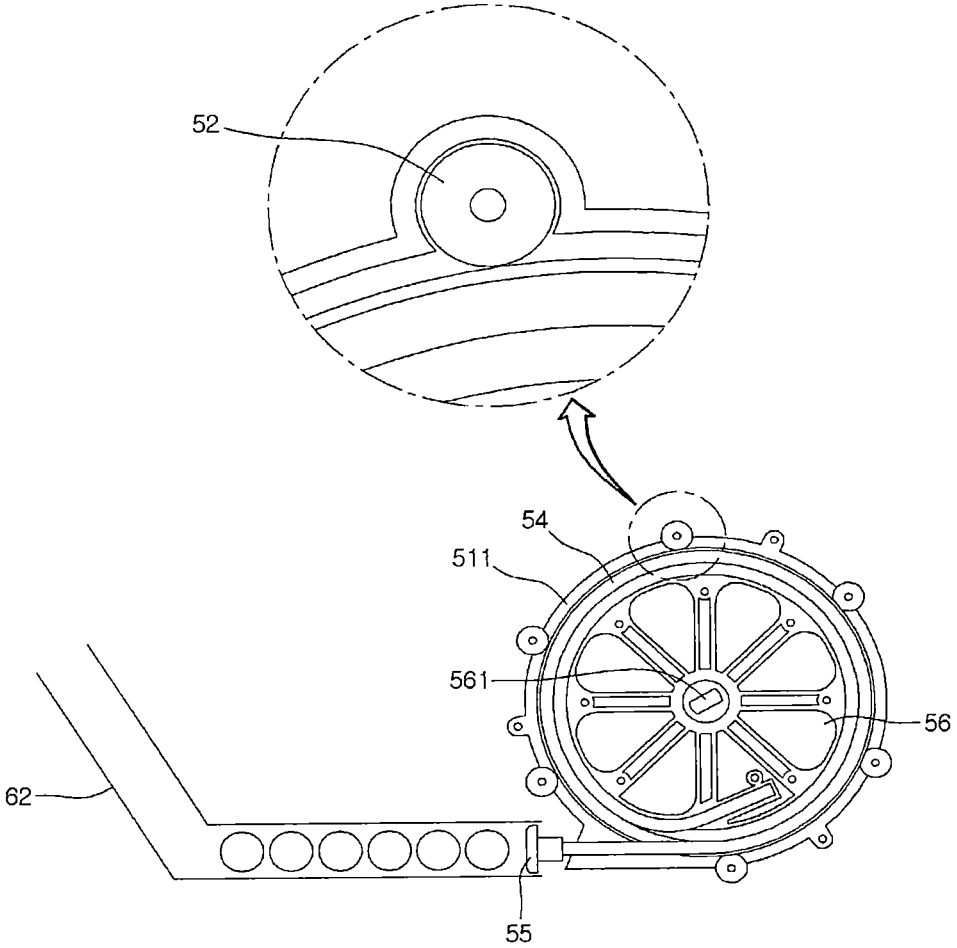

[Fig. 7]
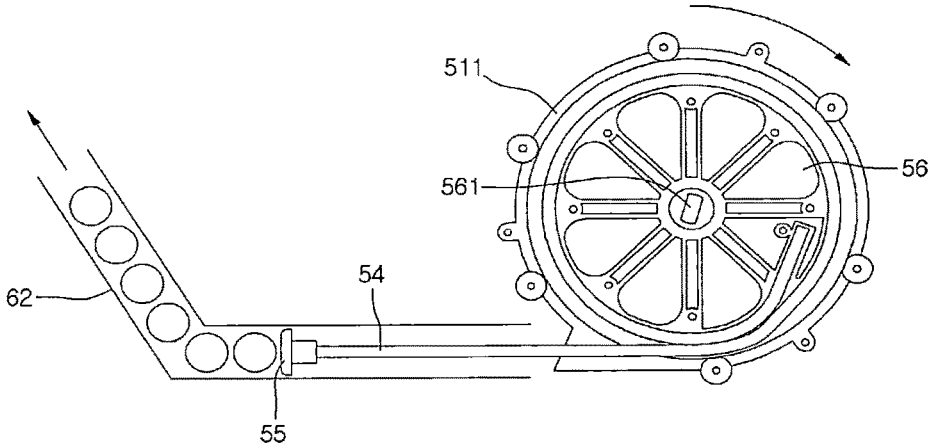
[Fig. 8]
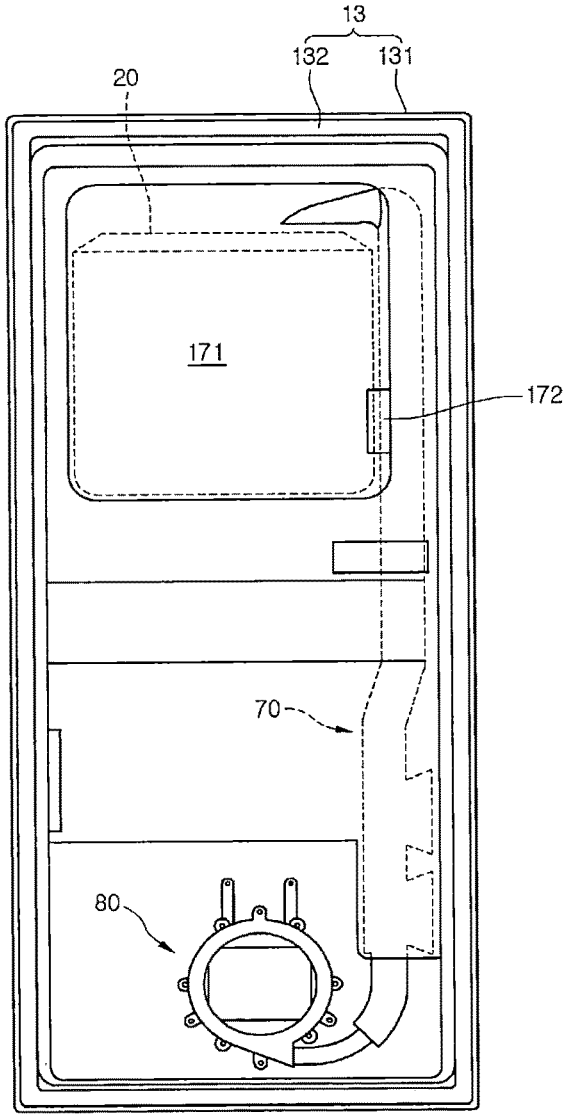

[Fig. 9]
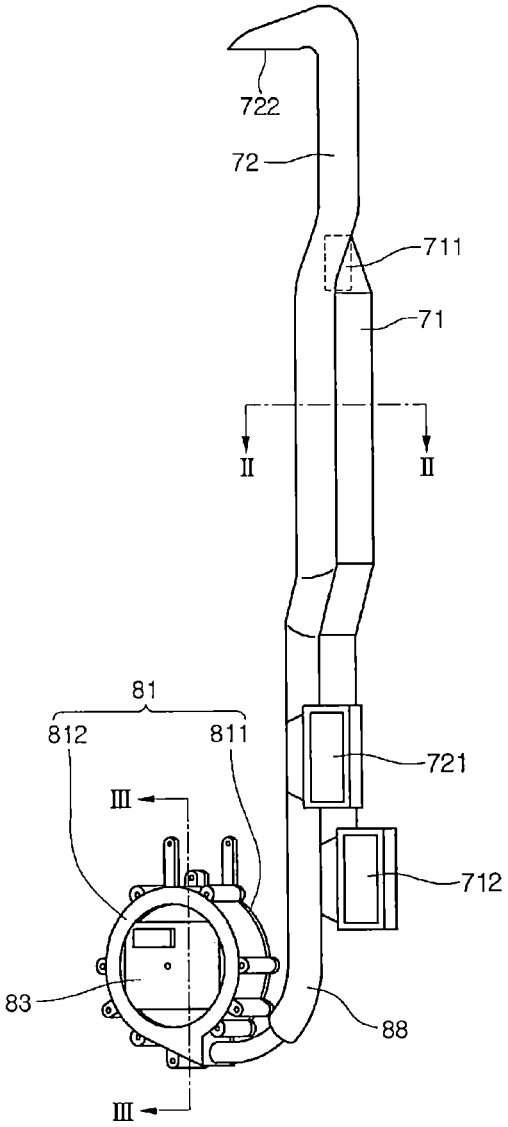
[Fig. 10]
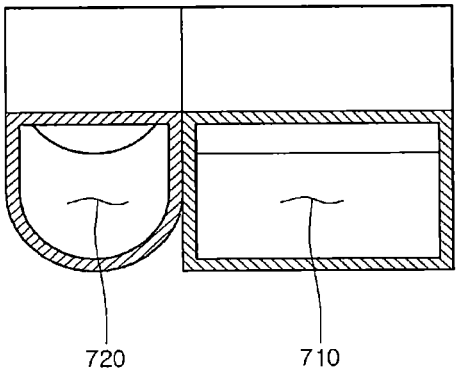

[Fig. 11]
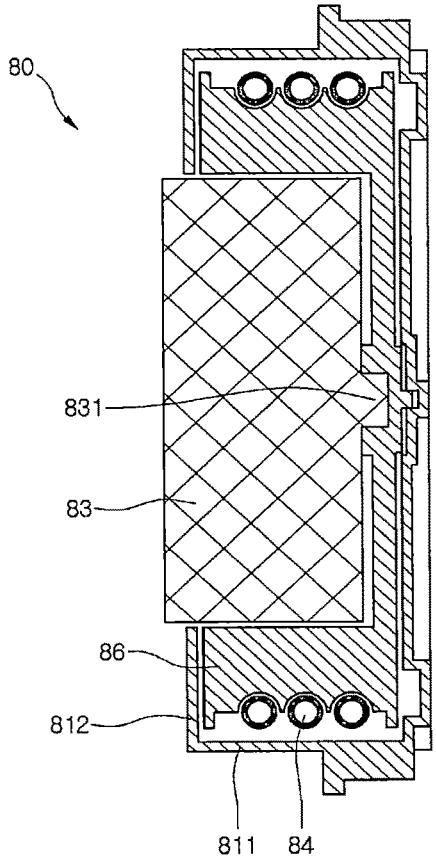
[Fig. 12]
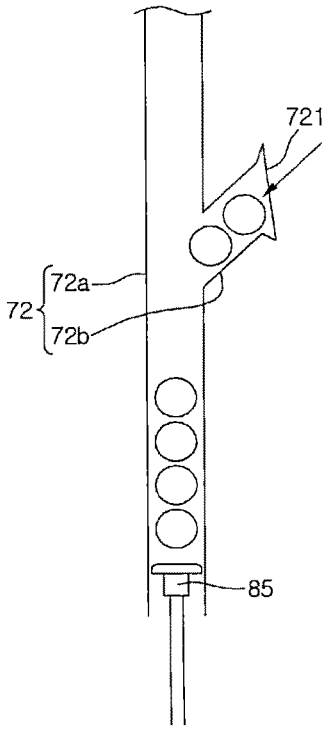

[Fig. 13]
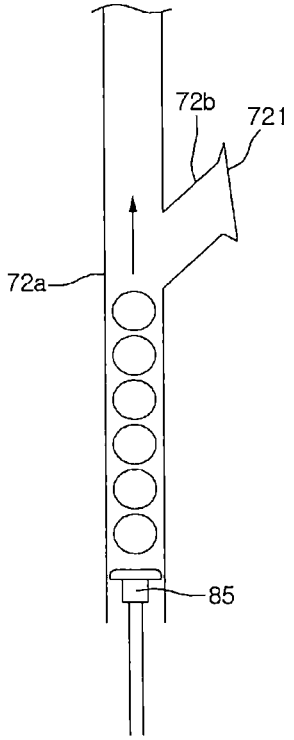
[Fig. 14]
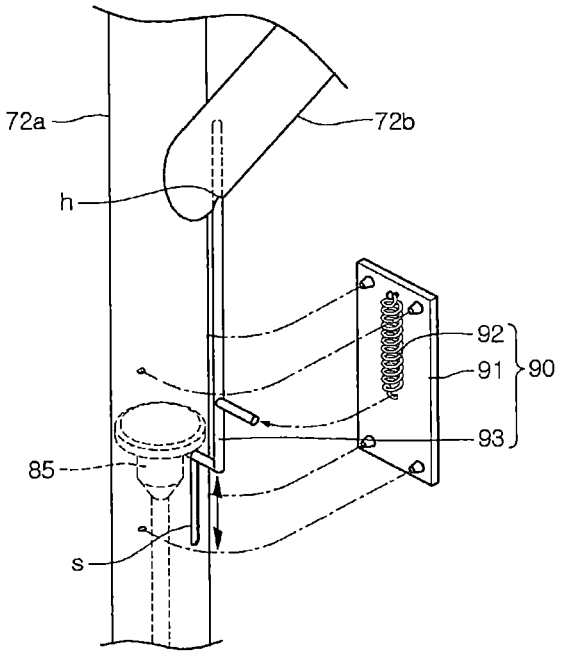

[Fig. 15]
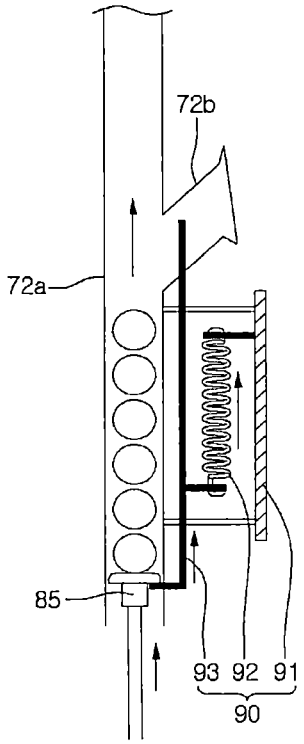
[Fig. 16]
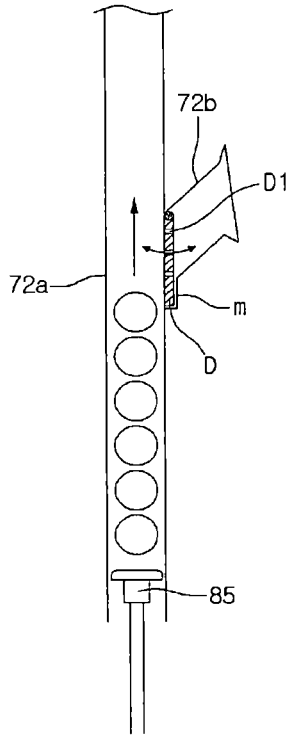

[Fig. 17]
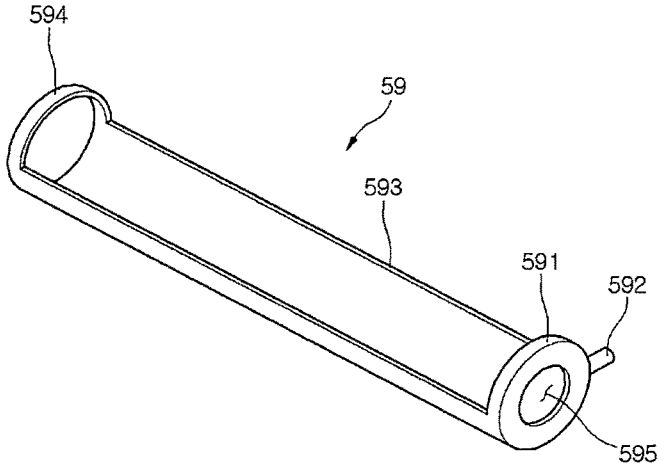
[Fig. 18]
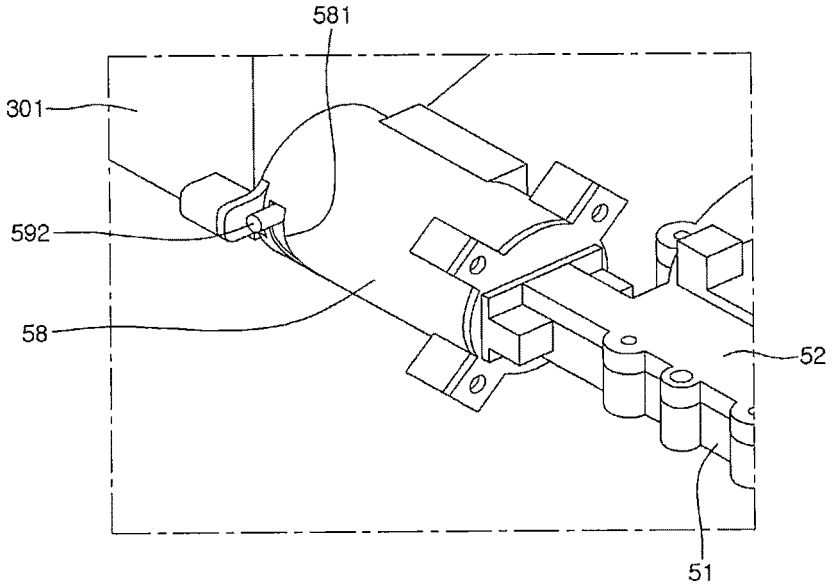
[Fig. 19]
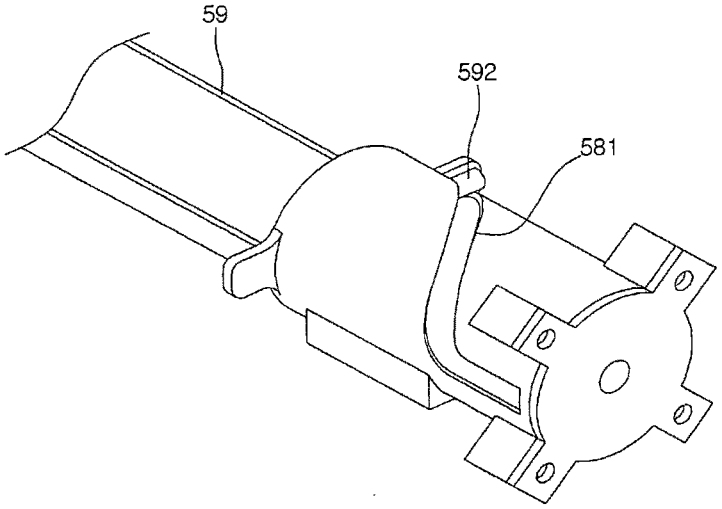

[Fig. 20]
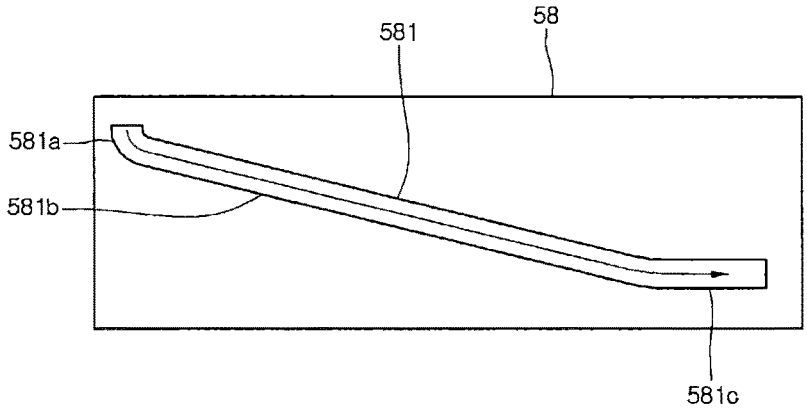
[Fig. 21]
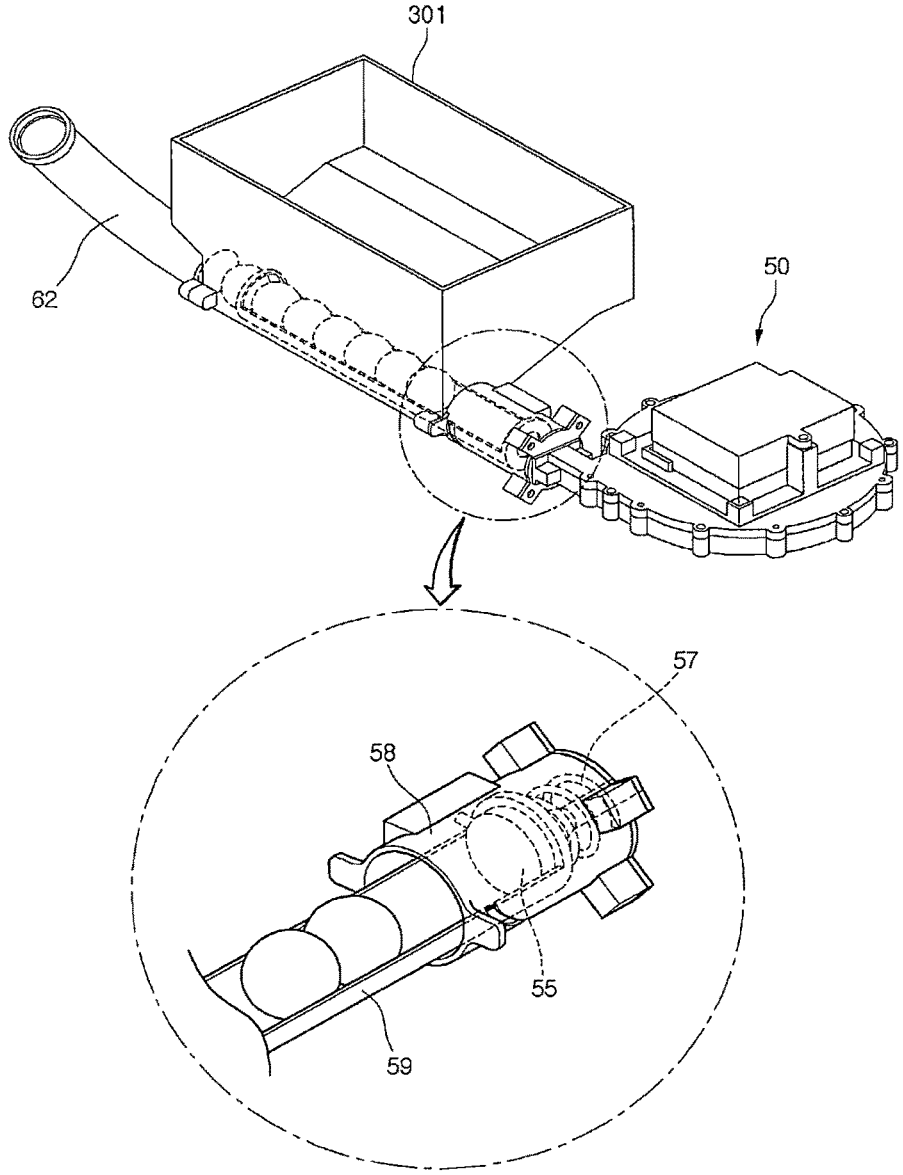

[Fig. 22]
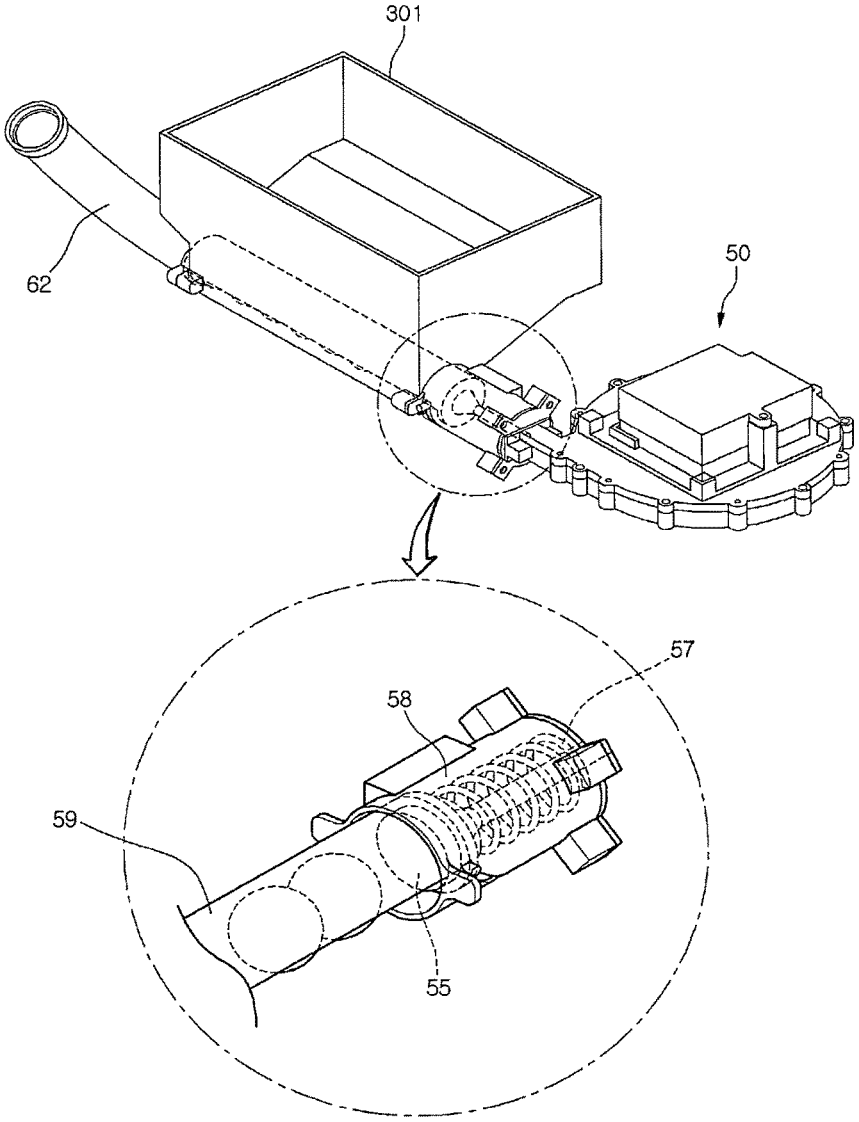
[Fig. 23]
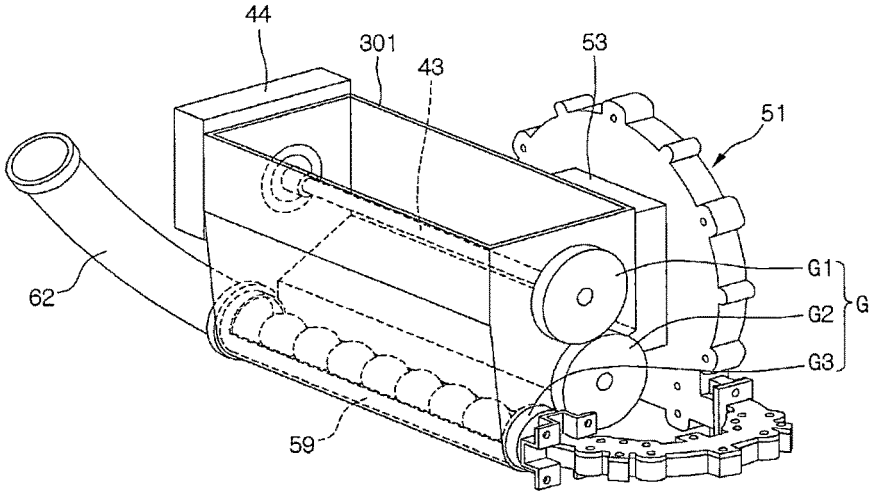

[Fig. 24]
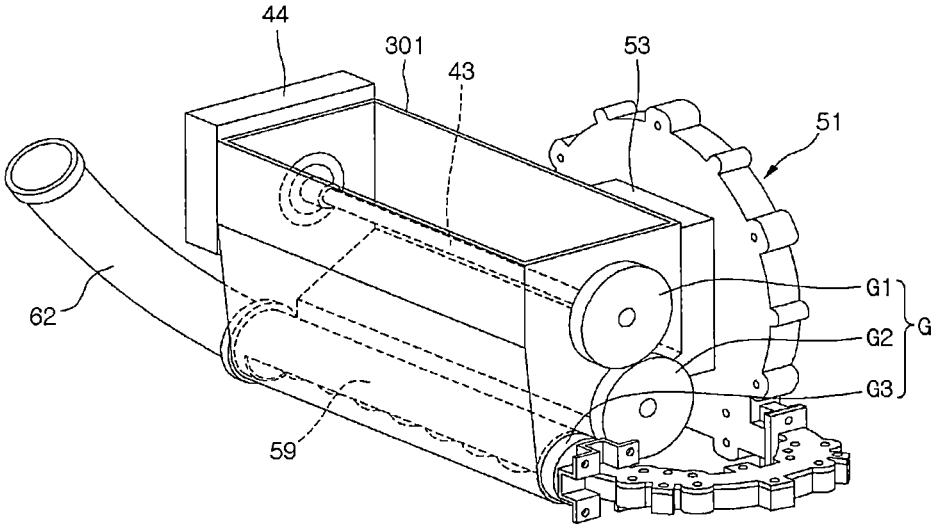

[Fig. 25]
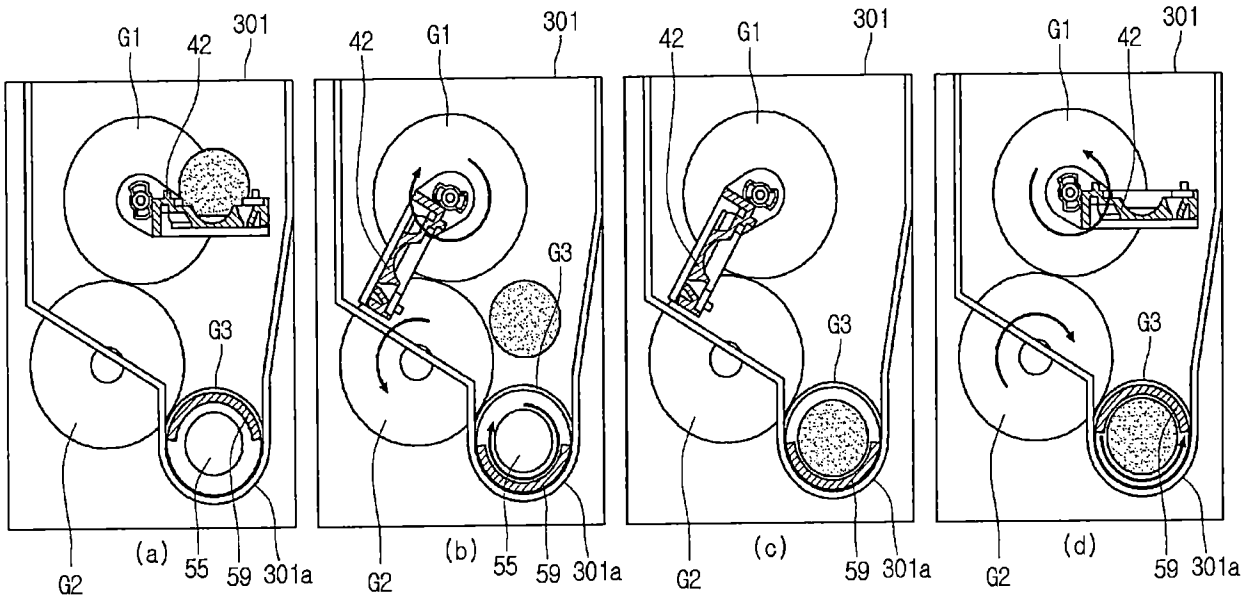

REFRIGERATOR

CROSS REFERENCE TO RELATED APPLICATIONS

This application is a U.S. National Phase Application under 35 U.S.C. § 371 of International Application PCT/KR2014/009338, filed on Oct. 2, 2014, which claims the benefit of Korean Application No. 10-2013-0118460, 10-2013-0118535 and 10-2013-0118536, all of which were filed on Oct. 4, 2013, the entire contents of which are hereby incorporated by reference in their entireties.

TECHNICAL FIELD

The present invention relates to a refrigerator.

BACKGROUND ART

Generally, a refrigerator is a home appliance which keeps food in an internal storage space shielded by a door at a low temperature.

A recently released refrigerator includes an icemaker for making ice. The icemaker is provided in a freezing compartment or a refrigerating compartment according to refrigerator model. A bottom freezer refrigerator having a refrigerating compartment provided above a freezing compartment includes a rotation refrigerating compartment door and a drawer type refrigerating compartment door. According to refrigerator model, an icemaker may be mounted in a refrigerating compartment, a refrigerating compartment door or a freezing compartment.

As disclosed in Korean Patent Application No. 2011-0091800 filed by the applicants of the present invention, a product including an icemaker provided in a freezing compartment and an ice bank provided in a refrigerating compartment for storing ice is proposed. Such a refrigerator requires a transfer mechanism for transferring ice made by the icemaker to the ice bank and spherical ice is made in the icemaker in order to easily transfer ice.

In an ice making assembly having such a structure, a distance from the icemaker to the ice bank is significantly large and noise may occur in a process of transferring ice. A transfer device having large driving power should be provided in order to transfer ice from the icemaker to the ice bank.

In the icemaker disclosed in the above-described Patent Application, ice dropped to a transfer member is pushed by rotation of the transfer member and moved to an ice bank along an ice chute. Accordingly, when ice is first made, since ice is not delivered to the ice back until the ice chute is filled with ice, it takes considerable time for a user to obtain ice.

The ice chute should always be filled with ice on an ice transfer path in order to transfer newly made ice by the transfer member and to drop previously made ice from the ice chute to the ice bank.

In such a structure, since ice is always laid on the ice transfer path, spheres of ice being in contact with each other on the ice transfer path may melt and adhere to each other. The adhered spheres of ice may not be easily transferred or may not be dropped from the ice chute to the ice bank.

In addition, when the spheres of ice are not easily transferred, overload is applied to a transfer motor for rotating the transfer member, increasing power consumption.

DISCLOSURE

Technical Problem

The present invention is proposed to solve the above-described problems.

Technical Solution

The object of the present invention can be achieved by providing a refrigerator including a cabinet including a refrigerating compartment and a freezing compartment provided below the refrigerating compartment, a refrigerating compartment door rotatably connected from a front surface of the cabinet to open or close the refrigerating compartment and including an ice storage compartment for storing ice, an ice bank provided in the ice storage compartment to store the ice, an icemaker including an upper tray forming a semi-spherical upper cell, a lower tray forming a semi-spherical lower cell and a rotation shaft for rotating the lower tray and provided in the freezing compartment, a housing for housing the icemaker in an upper space and having an ice collection part for collecting the ice separated from the icemaker, the ice collection part being formed in a lower end thereof, an ice transfer duct for connecting the housing the ice bank, and an ice transfer device for transferring the ice collected in the ice collection part to the ice bank along the ice transfer duct, wherein the ice transfer device includes a transfer cable, a pusher connected to an end of the transfer cable, and a transfer case in which the transfer cable is wound.

Advantageous Effects

An ice making assembly of a refrigerator of an embodiment of the present invention having the above-described structure have the following effects.

First, since an ice transfer section is divided into a refrigerator cabinet section and a refrigerator door section such that ice is independently transferred by an ice transfer device of each section, it is possible to reduce power consumption as compared to power consumed to transfer ice from an icemaker to an ice bank using one transfer device.

Second, since ice is transferred to an ice bank whenever being made and separated in an icemaker by providing an ice transfer device according to the embodiment of the present invention, ice is not left on an ice transfer path while the icemaker does not operate. Thus, spheres of ice do not adhere to each other on the ice transfer path.

Third, since spheres of ice do not adhere to each other on the ice transfer path, overload is not applied to a transfer motor.

Fourth, since a transfer chute covers the upper side of ice dropped to the transfer chute when ice is transferred, ice does not escape from the ice transfer path in a process of pushing ice using a pusher.

Additionally, since an icemaker is provided in a freezing compartment, the size of an ice bank can be increased as compared to a structure in which an icemaker and an ice bank arc provided in a refrigerating compartment door and, as a result, a large amount of ice can be stored.

In addition, since an icemaker is provided in a freezing compartment, the amount of ice made can be increased as compared to a structure in which an icemaker is provided in a refrigerating compartment, a time required to make ice can be shortened, and power consumed to make ice can be decreased.

In addition, since an icemaker is provided in a freezing compartment, the height of a dispenser provided in the front surface of a refrigerating compartment door can be further increased to increase user convenience.

In addition, since an icemaker is provided in a freezing compartment, a storage space of a most frequently used refrigerating compartment can be increased to increase user convenience.

DESCRIPTION OF DRAWINGS

FIG. 1 is a perspective view showing a refrigerator including an ice making assembly according to an embodiment of the present invention.

FIG. 2 is a perspective view showing the internal structure of a refrigerator including an ice making assembly according to an embodiment of the present invention.

FIG. 3 is a partial perspective view showing the internal structure of a storage compartment including an ice making assembly mounted therein according to an embodiment of the present invention.

FIG. 4 is a perspective showing an ice making assembly according to an embodiment of the present invention.

FIG. 5 is a cross-sectional view taken along line I-I of FIG. 4.

FIG. 6 is a diagram showing the internal structure of a transfer case configuring an ice transfer device.

FIG. 7 is a diagram showing operation of an ice transfer device according to an embodiment of the present invention.

FIG. 8 is a rear view of a refrigerating compartment door including an ice transfer device according to an embodiment of the present invention.

FIG. 9 is a perspective view of an ice transfer device mounted in the refrigerating compartment door.

FIG. 10 is a cross-sectional view taken along line II-II of FIG. 9.

FIG. 11 is a cross-sectional view taken along line of FIG. 9.

FIG. 12 is a diagram showing a process of transferring ice from a freezing compartment side transfer device to a door side transfer device.

FIG. 13 is a diagram showing transfer of ice to an ice bank using a door side transfer device.

FIGS. 14 and 15 are diagrams showing a reverse transfer prevention device provided in an ice transfer device according to an embodiment of the present invention.

FIG. 16 is a diagram showing an ice reverse transfer prevention device according to another embodiment of the present invention.

FIG. 17 is a perspective view showing a chute cover according to an embodiment of the present invention.

FIGS. 18 and 19 are perspective views showing a chute cover driving mechanism provided in an ice making assembly according to an embodiment of the present invention.

FIG. 20 is a view showing a state in which a transfer chute is unfolded.

FIG. 21 is a diagram showing a state just before ice is transferred.

FIG. 22 is a diagram a state when ice is transferred.

FIGS. 23 and 24 are perspective views showing a chute cover driving mechanism provided in an ice making assembly according to another embodiment of the present invention.

FIG. 25 is a diagram sequentially showing a process of operating a chute cover.

BEST MODE

FIG. 1 is a perspective view showing a refrigerator including an ice making assembly according to an embodiment of the present invention, FIG. 2 is a perspective view showing the internal structure of a refrigerator including an ice making assembly according to an embodiment of the present invention, and FIG. 3 is a partial perspective view showing the internal structure of a storage compartment including an ice making assembly mounted therein according to an embodiment of the present invention.

Referring to FIGS. 1 to 3, the refrigerator 10 including the ice making assembly 30 according to the embodiment of the present invention may include a cabinet 11 having a refrigerating compartment 111 and a freezing compartment 112 provided therein, a pair of refrigerating compartment doors 12 and 13 rotatably coupled to the front surface of the cabinet 11 to open or close the refrigerating compartment 111, and a drawer type freezing compartment door 16 for opening and closing the freezing compartment 112. A plurality of shelves 111*a* and a storage box 111*b* may be provided in the refrigerating compartment 111.

In addition, the refrigerator 10 according to the embodiment of the present invention may further include a dispenser 15 provided in the front surface of any one of the pair of refrigerating compartment doors 12 and 13 to retrieve water or ice. The ice making assembly 30 includes an ice storage compartment 171 connected to the refrigerating compartment door 13 having the dispenser 15 through a flow path to store ice in the rear surface of the refrigerating compartment door 13. The ice storage compartment 171 is selectively opened or closed by an ice storage compartment door 17. The ice storage compartment door 17 may be rotatably coupled to the rear surface of the refrigerating compartment door 13 defining the ice storage compartment 171.

In detail, the refrigerating compartment doors 12 and 13 include an outer case 131 forming an outer appearance of the refrigerator, a door liner 132 coupled to the rear surface of the outer case 131 and an insulating layer filled between the outer case 131 and the door liner 132. The upper side of the door liner 132 is recessed by a predetermined depth to form the ice storage compartment 171 and the ice storage compartment 171 is selectively opened or closed by the ice storing door 17. The ice storage compartment 171 may extend by a length corresponding to half the length of the door liner 132. An ice bank 20 (see FIG. 8) for storing ice is provided in the ice storage compartment 171 and the ice bank 20 may be provided separately from the ice storage compartment 171.

In addition, ice outlets are provided in the bottom of the ice bank 20 and the bottom of the ice storage compartment 171 to communicate with the dispenser 15. When a dispense button provided in the dispenser 15 is pressed, ice stored in the ice bank 20 is discharged to the dispenser 15 through the ice outlet.

In addition, a storage box 134 may be mounted in the front surface of the ice storage compartment door 17 and a storage box 133 may be mounted in the door liner 132 corresponding to the lower side of the ice storage compartment 17.

The ice making assembly 30 may include an icemaker 40 for making spherical ice, an ice transfer device 50 for transferring the ice made in the icemaker 40 to the ice bank 20, a first duct assembly 60 including an ice transfer duct 62 connected to the ice transfer device 50 to guide movement of the ice, an ice transfer device 80 mounted in the refrigerating compartment door 13 to transfer the ice transferred from the first assembly 60 to the ice bank 20 and a second duct assembly 70.

In detail, the icemaker 40 and the ice transfer device 50 may be mounted on the lower surface of a mullion 114.

Here, a vaporizing compartment 113 having a vaporizer (not shown) is provided at the rear side of the freezing compartment 112.

The ice transfer duct 62 configuring the first duct assembly 60 extends along the side of the cabinet 11 defining the freezing compartment 112 and the side of the cabinet 111 defining the refrigerating compartment 111. An end of the ice transfer duct 62, that is, the ice outlet 621 is exposed to the side of the refrigerating compartment 111.

In addition, the first duct assembly 60 further includes a cool air collection duct 61 for returning cool air supplied to the ice storage compartment 171 to the freezing compartment 112 or the vaporizing compartment 113. The cool air collection duct 61 extends along the inside of the side of the freezing compartment 112 and the refrigerating compartment 111 adjacent to the ice transfer duct 62. A cool air inlet 611 is exposed to the side of the refrigerating compartment 111 corresponding to the lower side of the ice outlet 621. In detail, one end of the cool air collection duct 61 communicates with the refrigerating compartment 112 or the vaporizing compartment 113 and the other end thereof becomes the cool air inlet 611. Accordingly, cool air dropped to the cool air inlet 611 is discharged to the freezing compartment 112 or the vaporizing compartment 113 along the cool air collection duct 61.

When the refrigerating compartment door 13 is closed, the cool air inlet 611 and the ice outlet 621 communicate with the second duct assembly 70 mounted in the refrigerating compartment door 13. The structure of the second duct assembly 70 will be described in greater detail below with reference to the drawings.

FIG. 4 is a perspective showing an ice making assembly according to an embodiment of the present invention.

Referring to FIG. 4, the ice making assembly 30 according to the embodiment of the present invention includes the icemaker 40 and the ice transfer device 50.

In detail, the icemaker 40 makes spherical ice and may include an upper tray 41, a lower tray 42 and a rotation shaft 43 connecting the upper tray 41 and the lower tray 43. An upper cell forming the first half of the spherical ice is provided in the upper tray 41 and a lower cell forming the second half of the spherical ice is provided in the lower tray 42. When ice is completely made, the lower tray 42 rotates about the rotation shaft 43 in a state in which the upper tray 41 is fixed, thereby separating the ice from the upper tray 41. The icemaker for making the spherical ice is described in detail in the above-described Patent Application No. 2011-0091800 and a description thereof will be omitted.

The icemaker 40 may be housed in a housing 301. The bottom of the housing 310 is inclined downward toward the front end thereof such that the ice separated from the icemaker 40 is collected in the front lower end of the housing 301. The front lower end of the housing 301 is rounded with a curvature corresponding to the diameter of the spherical ice to have a semi-cylindrical shape, thereby transferring spheres of ice in a line.

The inlet of the ice transfer duct 62 configuring the first duct assembly 60 is connected to the side of the housing 301. More specifically, the inlet of the ice transfer duct 62 is connected to the front side of the lateral side of the housing 301 such that the spheres of ice collected in the front lower end of the housing 301 are transferred to the ice transfer duct 62 in a line.

In addition, the ice transfer device 50 is connected to the side of the housing 301. In detail, a cylindrical transfer chute 58 configuring the ice transfer device 50 is connected to the front end of the side of the housing 301. That is, the ice transfer duct 62 and the transfer chute 58 are connected to both sides of the housing 301 at opposite positions. Accordingly, the center of the outlet of the transfer chute 58 and the center of the inlet of the ice transfer duct 62 are provided on the same line. Reference numeral 51 denotes a transfer case and reference numeral 53 denotes a transfer motor.

FIG. 5 is a cross-sectional view taken along line I-I of FIG. 4, and FIG. 6 is a diagram showing the internal structure of a transfer case configuring an ice transfer device.

Referring to FIGS. 5 and 6, the ice transfer device 50 may include the transfer chute 58, the transfer case 51 connected to the inlet of the transfer chute 58, a transfer disk 56 rotatably provided in the transfer case 51, the transfer motor 53 for rotating the transfer disk 56, a transfer cable 54 wound on the transfer disk 56 and a pusher 55 connected to the end of the transfer cable 54.

In detail, the transfer case 51 may be horizontally provided as shown or may be vertically provided. The transfer case may be appropriately provided according to the internal structure of the freezing compartment 112.

The transfer case 51 includes a circular rear cover 511 in which the transfer disk 56 is seated and a front cover 512 covering the rear cover 511. The rotation shaft 531 of the transfer motor 53 is inserted into a motor shaft insertion hole 561 formed in the center of the transfer disk 56 to rotate the transfer disk 56 at a predetermined speed.

As shown, the transfer cable 54 is wound on the outer circumferential surface of the transfer disk 56 in a stacked form. That is, the transfer cable is wound while expanding in the radius direction of the transfer disk 56. The pusher 55 is connected to the end of the transfer cable 54 and is received in the transfer chute 58.

In addition, a plurality of guide rollers 52 is provided in the inner edge of the transfer case 51 to minimize friction between the inner circumferential surface of the transfer case 51 and the transfer cable 54 when the transfer cable 54 is unwound. The transfer cable 54 may have softness enabling the transfer cable to be smoothly wound on the transfer disk 56 and have hardness disabling the transfer cable from being bent when the pusher 55 pushes and moves ice. The transfer cable 54 may have a tube shape.

FIG. 7 is a diagram showing operation of an ice transfer device according to an embodiment of the present invention.

Referring to FIG. 7, when spheres of ice are completely made and separated in the icemaker 40, the separated spheres of ice are dropped and collected in the front edge of the housing 301. Then, the spheres of ice are aligned in a line in an ice collection part formed in the front edge of the housing 301. As described above, the semi-cylindrical ice collection part is formed in the front lower end of the housing 301, the transfer chute 58 is connected to one end of the ice collection part and the ice transfer duct 62 is connected to the other end of the ice collection part.

In detail, ice transfer is performed whenever the spheres of ice are separated in the icemaker 40 and collected in the ice collection part. That is, the number of ice making cycles of the icemaker 40 is equal to the number of times of ice transfer.

For transfer, the transfer motor 53 is driven to rotate the transfer disk 56 in one direction. Then, the transfer cable 54 wound on the transfer disk 56 is unwound such that the pusher 55 located at the outlet of the transfer case 51 extends. The pusher 55 pushes and sends the spheres of ice aligned in a line in the ice collection part of the housing 301 to the ice transfer duct 62. The transfer cable 54 has a length enabling the pusher 55 to be moved to the outlet of the ice transfer duct 62, that is, the ice outlet 621. Here, the ice transfer duct 62 serves to transfer the spheres of ice and serves as a cool air supply duct for guiding cool air in the freezing compartment 112 to the ice bank 20. Therefore, the spheres of ice transferred along the ice transfer duct 62 can be prevented from melting and adhering to each other and a separate cool air supply duct for supplying cool air to the ice bank 20 does not need to be provided.

When the spheres of ice collected in the housing 301 are transferred to the ice transfer device provided in the refrigerating compartment door 13, the transfer motor 53 rotates in a reverse direction to wind the transfer cable 54. Driving of the transfer motor 53 is stopped when the pusher 55 reaches the outlet of the transfer case 511.

FIG. 8 is a rear view of a refrigerating compartment door including an ice transfer device according to an embodiment of the present invention, FIG. 9 is a perspective view of an ice transfer device mounted in the refrigerating compartment door, FIG. 10 is a cross-sectional view taken along line II-II of FIG. 9, and FIG. 11 is a cross-sectional view taken along line III-III of FIG. 9.

Referring to FIGS. 8 to 11, the refrigerating compartment door 13 of the refrigerator according to the embodiment of the present invention may include the outer case 131, the door liner 132 and the insulating layer as described above. The edge of the door liner 132 protrudes to form a door dike and the ice storage compartment 171 is formed at the upper side of the door liner 132 corresponding to the inside of the door dike. The ice storage compartment 171 is selectively opened or closed by the ice storage compartment door 17. The ice bank 20 is mounted in the ice storage compartment 171. The ice outlet is formed in the bottom of the ice storage compartment 171 and the bottom of the ice bank 20.

In detail, the second duct assembly 70 for transferring the spheres of ice and guiding cool air and the ice transfer device 80 are mounted in the refrigerating compartment door 13, that is, between the outer case 131 and the door liner 132. The ice transfer device 80 is mounted at the lower side of the refrigerating compartment door 13 and the second duct assembly 70 is connected to the ice transfer device 80 to extend to the upper end of the ice storage compartment 171.

As described with reference to FIG. 5, the ice transfer device 80 may include a transfer motor 83, a transfer case 81, a transfer disk 86, a transfer cable 84 and a pusher 85 (see FIG. 12). The transfer case 81 includes a rear cover 811 and a front cover 812 and the transfer disk 86 is rotatably provided in a space formed by the rear cover 811 and the front cover 812. The rotation shaft 831 of the transfer motor 83 is inserted into the central part of the transfer disk 86 to rotate the transfer disk 86. The transfer chute 88 extends in the transfer case 81 and the pusher 85 is located in the transfer chute 88.

In the present embodiment, the transfer cable 84 is wound on the outer circumferential surface of the transfer disk 86 in the thickness direction of the transfer disk 86. The transfer cable 84 may be wound in any one of the form shown in FIG. 5 or the form shown in the present embodiment.

The second duct assembly 70 includes a cool air collection duct 71 and an ice transfer duct 72. The ice transfer duct 72 extends upward along the edge of the door liner 132 and the inlet thereof is connected to the transfer chute 88 and the ice outlet 722 corresponding to the outlet of the ice transfer duct is located above the ice bank 20. The cool air collection duct 71 is provided to be closely adhered to the outer side of the ice transfer duct 72 and extends upward. As shown in FIG. 10, the ice transfer duct 72 and the cool air collection duct 71 are provided adjacent to each other and may be provided as one module. The cross section of an ice transfer path 720 formed in the ice transfer duct 72 partially has a circular shape in order to smoothly transfer the spheres of ice. The cross section of the cool air passage in the cool air collection duct 71 may have various shapes such as a rectangular or circular shape.

In addition, the ice transfer duct extends to any one side of the ice transfer duct 72 or any point close to the ice transfer device 80. Hereinafter, as shown FIGS. 12 and 13, in the ice transfer duct 72, a duct extending upward along the door linear 132 is defined as a main duct 72*a* and the ice transfer duct branched from the main duct 72*a* is defined as a sub duct 72*b*. An ice inlet 721 is formed in the end of the sub duct 72*b* and a communication hole is formed in the side of the door liner 132 corresponding to the ice inlet 721.

In addition, the cool air outlet 712 is formed in the lower end of the cool air collection duct 71 and the cool air inlet 711 is formed in the upper end of the cool air collection duct. The cool air output 712 may be located below the ice inlet 721 of the sub duct 72*b*. The cool air collection port 172 is formed in the lower side of the lateral side of the ice storage compartment 171 and the cool air inlet 711 of the cool air collection duct 71 is coupled to the cool air collection port 172.

By such a structure, when the refrigerating compartment door 13 is closed, the ice inlet 721 communicates with the ice outlet 621 (see FIG. 3) formed in the side of the refrigerating compartment 111 and the cool air outlet 712 communicates with the cool air inlet 611 (see FIG. 3). Accordingly, the spheres of ice transferred by the ice transfer device 50 provided in the freezing compartment 112 and the cool air of the freezing compartment are moved along the ice transfer duct 62 and the spheres of ice passing through the ice outlet 621 are transferred to the ice transfer device 80 mounted in the refrigerating compartment door 13 via the sub duct 72*b*. Then, the spheres of ice rise along the ice transfer duct 72 by the ice transfer device 80 and finally drops to the ice bank 20. In addition, the cool air of the refrigerating compartment is supplied to the ice storage compartment 171.

In addition, the cool air of the ice storing chamber 171 is discharged via the cool air collection port 172 provided in the side of the ice storage compartment 171, is dropped through the cool air collection duct 71 and then is guided to the cool air collection duct 61 provided in the side of the refrigerating compartment 111 via the cool air outlet 712. The collected cool air guided to the cool air collection duct 61 is guided to the freezing compartment 112 or the vaporizing compartment 113.

According to the ice making assembly of the embodiment of the present invention, the spheres of ice made in the icemaker 40 provided in the freezing compartment 112 are finally transferred to the ice bank 20 through a two-step transfer process.

FIG. 12 is a diagram showing a process of transferring spheres of ice from a freezing compartment side transfer device to a door side transfer device, and FIG. 13 is a diagram showing transfer of ice to an ice bank using a door side transfer device.

Here, the transfer device 50 provided in the freezing compartment 112 may be defined as a first transfer device and the transfer device 80 provided in the refrigerating compartment door 13 may be defined as a second transfer device.

In detail, the sub duct 72*b* extends from the main duct 72*a* to be inclined upward such that the spheres of ice transferred by the first transfer device are dropped to the second transfer device by gravity. When the spheres of ice transferred by the first transfer device are stacked on the pusher 85 of the second transfer device, the transfer motor 83 of the second transfer device is driven such that the pusher 85 pushes the spheres of ice up.

The pusher 85 rises to a point where lowermost ice placed on the upper surface of the pusher 85 drops to the ice bank 20. Then, when all spheres of ice drop to the ice bank 20, the transfer motor 83 reversely rotates and the pusher 85 returns to the transfer chute 88.

FIGS. 14 and 15 are diagrams showing a reverse transfer prevention device provided in an ice transfer device according to an embodiment of the present invention.

As described with reference to FIGS. 12 and 13, when the spheres of ice move toward the ice bank 20, the ice may be transferred in a reverse direction. In detail, some of the spheres of ice rising along the main duct 72*a* may move into the sub duct 72*b*. When the pusher 85 passes by the sub duct 72*b* to further rise, the spheres of ice moving into the sub duct 72*b* may drop to the transfer chute 88. Then, when the pusher 85 returns to an original position, the pusher may not enter the transfer chute 88 due to the ice dropping to the transfer chute 88. As a result, ice transfer may be impossible.

In order to prevent this problem, some spheres of ice need to be prevented from being reversely transferred to the sub duct 72*b* in an ice transfer process.

Referring to FIGS. 14 and 15, the ice reverse transfer prevention device 90 according to the embodiment of the present invention may include a shutter 93 having one end connected to the pusher 85 through the main duct 72*a* and moving in an upper-and-lower direction, an elastic member 92 for applying elastic force such that the shutter 93 returns to an original position and a bracket 91 supporting the elastic member 92.

In detail, the bracket 91 may be fixed to the outer circumferential surface of the main duct 72*a*. One end of the elastic member 92 is connected to the rear surface of the bracket 91 and the other end thereof is connected to the shutter 93.

In addition, a slit s having a predetermined length in an upper-and-lower direction is formed in the main duct 72*a* and one end of the shutter 93 is connected to the pusher 85 through the slit. Here, one end of the shutter 93 is engaged with the pusher 85 without being fixed to the pusher 85. A through-hole h into which the other end of the shutter 93 may be inserted is formed in the sub duct 72*b*.

In operation of the ice reverse transfer prevention device 90 having the above-described structure, one end of the shutter 93 is engaged with the pusher 85 in a state in which the spheres of ice are not transferred. The other end of the shutter 93 is not inserted into the through-hole h of the sub duct 72*b*. The elastic member 92 extends to accumulate restoring force.

In this state, the spheres of ice are transferred from the sub duct 72*b* to the main duct 72*a* to be stacked on the upper surface of the pusher 85. When the spheres of ice are primarily transferred to the pusher 85, the pusher 85 starts to rise in order to transfer the spheres of ice to the ice bank 20. Then, the elastic member 92 contracts by the restoring force of the elastic member 92. The pusher 85 and the shutter 93 simultaneously rise and the other end of the shutter 93 is inserted into the through-hole h to be inserted into the sub duct 72*b*. When the elastic member 92 is returned to an original state, the shutter 93 no longer rises and only the pusher 85 continuously rises. As another method, the pusher may rise until the shutter 93 is engaged with the upper end of the slit s.

In a state in which the shutter 93 is inserted into the sub duct 72*b*, some of the spheres of ice rising along the main duct 72*a* are prevented from being reversely transferred along the sub duct 72*b* by the shutter 93.

Meanwhile, after all spheres of ice are transferred to the ice bank 20 by the pusher 85, the pusher 85 falls again. As the pusher 85 falls, one end of the shutter 93 is engaged with the pusher 85. As the pusher 85 further falls, the shutter 93 falls and thus the elastic member 92 extends. The other end of the shutter 93 escapes from the through-hole h and thus the spheres of ice may be transferred to the sub duct 72*b* to the main duct 72*a*.

In addition, the shutter 93 falls simultaneously with the pusher 85 until the pusher 85 falls and stops and the position where the shutter 93 stops and the position of the lower end of the slit s are equal.

FIG. 16 is a diagram showing an ice reverse transfer prevention device according to another embodiment of the present invention.

Referring to FIG. 16, the ice reverse transfer prevention device according to another embodiment of the present invention includes a damper D.

In detail, the damper D may be rotatably provided at a position where the main duct 72*a* and the sub duct 72*b* meet. A step difference m in which the end of the damper D is seated may be formed in the sub duct 72*b*. In a state in which the damper D is seated in the step difference m, the inner side of the damper D, that is, the surface facing the inner space of the main duct 72*a*, and the inner circumferential surface of the main duct 72*a* form the same plane such that the spheres of ice are not caught in the damper D in an ice transfer process. A plurality of cool air holes D1 is formed in the damper D such that cool air supplied from the freezing compartment is continuously supplied to the main duct 72*a* even in a state in which the damper D is seated in the step difference m.

In addition, an elastic member such as a torsion spring is mounted in the rotation shaft of the damper D such that the damper D rotates toward the inner space of the main duct 72*a* by the load of the transferred spheres of ice when the spheres of ice are transferred in the sub duct 72*b*, thereby opening the outlet of the sub duct 72*b*. When ice is not present in the sub duct 72*b*, the damper D seated in the step difference m is maintained by the restoring force of the elastic member.

By the above-described ice reverse transfer prevention device, it is possible to prevent the spheres of ice from being returned to the sub duct 72*b*.

FIG. 17 is a perspective view showing a chute cover according to an embodiment of the present invention.

A semi-cylindrical ice collection part is formed in the front lower end of the housing 301 and the spheres of ice aligned in the ice collection part are pushed and transferred by the pusher toward the ice transfer duct. At this time, when the pusher pushes the spheres of ice, foremost ice is caught in the inlet of the transfer duct, ice located at the middle part may be bounced up by the pressure of the pusher. The spheres of ice pressurized by the pusher need to be aligned in a line to be smoothly transferred to the ice transfer duct.

Referring to FIG. 17, a semi-cylindrical chute cover 59 is provided in the ice collection part formed in the housing 301.

In detail, the chute cover 59 may include a semi-cylindrical ice container 593, a base part 591 formed at one end of the ice container 593, an extension protrusion 592 protruding from the base part 592 and an arch-shaped supporting part 594 formed at the other end of the ice container 593. A pusher hole 595, through which the pusher 55 passes, is formed in the base part 591.

In greater detail, the base part 591 and the support part 594 have a circular shape such that the chute cover 59 smoothly rotates on the ice collection part in the housing 301. The pusher 55 pushes and transfers the spheres of ice dropped to the ice container 593 while passing through the pusher hole 595 and moving along the ice container 593. That is, the spheres of ice dropped to the ice container 593 are transferred to the ice transfer duct 62 through the support part 594.

FIGS. 18 and 19 are perspective views showing a chute cover driving mechanism provided in an ice making assembly according to an embodiment of the present invention, and FIG. 20 is a view showing a state in which a transfer chute is unfolded.

Referring to FIGS. 18 to 20, a spiral guide slit 581 is formed in the transfer chute 58 and the guide slit 581 extends from the outlet to the inlet of the transfer chute 58.

In detail, the guide slit 581 includes an engagement part 581 with which an extension protrusion 592 of the chute cover 59 is engaged, an inclination part 581*b* spirally extending from the engagement part 581*a* and a straight-line part 581*c* extending from the end of the inclination part 581*b* in a straight line.

As the pusher 58 moves in the transfer chute 58 in a front-and-rear direction, the chute cover 59 also moves in the front-and-rear direction. When the chute cover 59 moves in the front-and-rear direction, the chute cover 59 rotates by 180 degrees while the extension protrusion 592 moves along the guide slit 581. The operation mechanism of the pusher 58 and the chute cover 59 will be described in greater detail below with reference to the drawings.

FIG. 21 is a diagram showing a state just before ice is transferred, and FIG. 22 is a diagram showing a state when ice is transferred.

First, referring to FIG. 21, the spheres of ice made in the icemaker 40 drop to be collected in the ice collection part of the housing 301. Here, the chute cover 59 is movably placed in the ice collection part. When the spheres of ice drop to the ice collection part, the upper opening of the chute cover 59 is placed upward such that the spheres of ice dropping to the ice collection part are collected in the ice container 593 of the chute cover 59.

In detail, the pusher 55 is provided in the transfer chute 58 and an elastic member is provided behind the pusher 55. The pusher 55 is positioned in front of the base part 591 of the chute cover. The transfer cable 54 extending on the rear surface of the pusher 55 is wound on the transfer case 51 through the pusher hole 595 of the base part 591.

In addition, when the spheres of ice made in the icemaker 40 are transferred, the pusher 55 is located at the inlet side of the transfer chute 58 and the base part 591 of the chute cover 59 is also moved along with the transfer chute 58 and is located at the inlet of the transfer chute 58. The elastic member 57 provided at the rear side of the pusher 55 is compressed as the pusher 55 moves back. Here, when the chute cover 59 moves, the extension protrusion 592 of the base part 591 moves along the guide slit 581 formed in the transfer chute 58. That is, the extension protrusion 592 moves from the engagement part 581*a* of the guide slit 581 to the end of the straight-line part 581*c* along the inclination part 581*b*. Since the guide slit 581 is spirally formed along the transfer chute 58, the chute cover 59 rotates by 180 degrees when the extension protrusion 592 moves along the guide slit 581. Accordingly, when the extension protrusion 592 is located at the end of the straight-line part 581*c* of the guide slit 581, the ice container 593 of the chute cover 59 is located at the bottom of the ice collection part of the housing 301 and the upper side of the chute cover is opened. In this state, the spheres of ice dropping from the icemaker 40 are aligned in the ice container 593 of the chute cover 59 in a line.

Referring to FIG. 22, when the spheres of ice are all collected and aligned in the ice container 593, the pusher 44 moves forward while the transfer cable 54 is unwounded and the chute cover 59 moves forward when the pusher 55 moves forward. The elastic member 57 expands.

In detail, when the chute cover 59 moves forward, the extension protrusion 592 rotates and moves along the guide slit 581 and, as a result, the chute cover 50 also rotates and moves forward. When the extension protrusion 592 moves along the straight-line part 581*c* and the inclination part 581*b* to reach the engagement part 581*a*, the ice container 593 of the chute cover 59 rotates by 180 degrees to shield the upper space of the ice collection part of the housing 301. In this state, only the pusher 55 moves forward to transfer the spheres of ice and moves into the ice transfer duct 62 through the supporting part 594 of the chute cover 59.

When the spheres of ice are pushed and moved by the pusher 55, since the ice container 593 of the chute cover 59 covers the upper side of the spheres of ice, the spheres of ice are prevented from being bounced up toward the housing 301. That is, the spheres of ice collected in the ice collection unit are transferred to the ice transfer duct 72 in a state of being aligned in a line.

FIGS. 23 and 24 are perspective views showing a chute cover driving mechanism provided in an ice making assembly according to another embodiment of the present invention, and FIG. 25 is a diagram sequentially showing a process of operating a chute cover.

Referring to FIGS. 23 and 24, in the chute cover driving mechanism according to another embodiment of the present invention, a plurality of gear assemblies is mounted in the rotation shaft 43 for rotating the lower tray 42 of the icemaker 40 such that the chute cover 59 rotates by rotation force of the rotation shaft 43.

In detail, although the transfer case 51 is vertically provided at the back side of the housing 301, the present invention is not limited thereto and the transfer case may be horizontally provided at the lower side of the housing 301.

In addition, a gear box 44 having a motor for driving the rotation shaft 43 and a gear assembly may be mounted at one side of the outside of the housing 301. The rotation shaft 43 passes through the housing 301 and extend to the side opposite to the side at which the gear box 44 is provided. In addition, a gear assembly G for rotating the chute cover 59 is mounted at the other side of the outside of the housing 301 opposite to the side at which the gear box 44 is mounted.

In detail, the gear assembly G may include a first gear G1 connected to the rotation shaft 43, a second gear G2 engaged with the first gear G1 and a third gear G3 engaged with the second gear G2. The base part 591 of the chute cover 59 is connected to the third gear G3. The first gear G1 may be defined as a driving gear, the third gear may be defined as a driven gear and the second gear G2 may be defined as a transmission gear.

Although the structure in which the rear surface of the base part 591 of the chute cover 59 is attached to the front surface of the third gear G3 such that the third gear G3 and the base part 591 simultaneously rotate is shown in the figure, the present invention is not limited thereto. For example, gear teeth may be formed on the outer circumferential surface of the base part 591 and the third gear G3 may be meshed with the base part 591.

In the present embodiment, the gear assembly G includes three gears to rotate the chute cover 59. That is, the rotation direction of the rotation shaft 43 is equal to that of the chute cover 59, in consideration of the size of the side of the housing 301 and the distance between the first gear G1 and the chute cover 59. Accordingly, the present invention is not limited thereto. In other words, the rotation direction of the rotation shaft 43 may not be equal to that of the chute cover 59 and the chute cover 59 rotates by 180 degrees until the lower tray 42 may rotate at a maximum angle in a state of closely adhering to the upper tray 41. Accordingly, the third gear G3 may be directly connected to the first gear G1 and the outer circumferential surface of the base part 591 of the chute cover 59 may be directly meshed with the first gear G1. However, in order to apply the changed structure, a design problem that the diameter of the first gear G1 becomes greater than the width of the housing 301 by directly engaging the gear part of the first gear G1 with the chute cover 59 or the third gear G3 should be considered.

FIG. 23 shows a state in which the ice container 591 of the chute cover 59 is located on the bottom of the ice collection part of the housing 301 while the spheres of ice dropping from the icemaker 40 are collected in the chute cover 59. FIG. 24 shows a state in which all spheres of ice drop to the chute cover 59 and the ice container 591 rotates by 180 degrees to cover the upper side of the spheres of ice when ice transfer starts. In this state, the spheres of ice are prevented from being bounced up in an ice transfer process and the spheres of ice are guided to the ice transfer duct 62 in a state of being aligned in a line.

Referring to (a) of FIG. 25, the lower tray 42 is maintained in a horizontal state in a state in which the spheres of ice are made in the icemaker 40, the ice container 593 of the chute cover 59 is located at the upper side of the ice collection part to cover the upper side of the ice collection part 301*a* of the housing 301.

Referring to (b) of FIG. 25, ice is completely made and then the lower tray 42 starts to rotate. Then, the first gear G1 connected to the rotation shaft 43 starts to rotate and the second gear G2 and the third gear G3 also rotate. The chute cover 59 rotates along with the third gear G3 such that the spheres of ice separated from the lower tray 42 drop to the ice container 593 of the chute cover 59. When the lower tray 42 maximally rotates, the ice container 593 of the chute cover 59 rotates by 180 degrees to be located on the bottom of the ice collection part 301*a*.

Referring to (c) and (d) of FIG. 25, as the lower tray 42 reversely rotates to the original position, the chute cover 59 rotates by 180 degrees in a reverse direction. In this state, the pusher 55 moves forward to push the spheres of ice.

The lower tray 42 of the icemaker 40 and the chute cover 59 simultaneously rotate such that the spheres of ice are aligned in a line and guided to the ice transfer duct 62.

The invention claimed is:

1. A refrigerator comprising:

a cabinet including a refrigerating compartment and a freezing compartment provided below the refrigerating compartment;

a refrigerating compartment door rotatably connected from a front surface of the cabinet to open or close the refrigerating compartment and including an ice storage compartment for storing ice;

an ice bank provided in the ice storage compartment to store the ice;

an icemaker including an upper tray forming a semi-spherical upper cell, a lower tray forming a semi-spherical lower cell and a rotation shaft for rotating the lower tray and provided in the freezing compartment;

a housing for housing the icemaker in an upper space and having an ice collection part for collecting the ice separated from the icemaker, the ice collection part being formed in a lower end thereof;

an ice transfer duct for connecting the housing the ice bank; and an ice transfer device for transferring the ice collected in the ice collection part to the ice bank along the ice transfer duct, wherein the ice transfer device includes:

a transfer cable;

a pusher connected to an end of the transfer cable; and a transfer case in which the transfer cable is wound.

2. The refrigerator according to claim 1, wherein the ice collection part is recessed in a semi-cylindrical shape in the front lower end of the housing.

3. The refrigerator according to claim 1, wherein the ice transfer device further includes:

a transfer disk rotatably provided in the transfer case and having an outer circumferential surface on which the transfer cable is wound; and a transfer motor for rotating the transfer disk.

4. The refrigerator according to claim 3, wherein the transfer cable is wound to be stacked in a radius direction of the transfer disk.

5. The refrigerator according to claim 3, wherein the transfer cable is wound in a thickness direction of the transfer disk.

6. The refrigerator according to claim 3, further comprising a plurality of guide rollers provided in an edge of the transfer case to reduce friction with an inner circumferential surface of the transfer case when the transfer cable is unwound.

7. The refrigerator according to claim 1, wherein:

the ice transfer device includes:

a first transfer device connected to one side of the housing; and a second transfer device mounted in the door, and the ice transfer duct includes:

a first transfer duct having an inlet connected to the other side of the housing, extending along the side of the cabinet and having an outlet formed in the inside of the side of the refrigerator; and a second transfer duct mounted in the door to transfer the ice transferred from the first transfer duct to the ice bank.

8. The refrigerator according to claim 7, wherein the second transfer duct includes:

a main duct having an inlet connected to a transfer chute of the second transfer device and an outlet connected to the ice storage compartment; and a sub duct extending from any point of the main duct.

9. The refrigerator according to claim 8, wherein the inlet of the sub duct is formed at the side of the door and the inlet of the sub duct communicates with the outlet of the first transfer duct in a state of closing the door.

10. The refrigerator according to claim 1, wherein cool air supplied to the freezing compartment is moved along the ice transfer duct to be supplied to the ice storage compartment.

11. The refrigerator according to claim 1, further comprising a cool air collection duct provided to return cool air of the ice storage compartment to at least the freezing compartment, wherein the cool air collection duct includes:

a first cool air collection duct provided in the door and having one end thereof connected to the ice storage compartment and the other end thereof formed in the side of the door; and a second cool air collection duct having an inlet formed in the side of the refrigerating compartment and an outlet communicating with the freezing compartment or a vaporizing compartment provided behind the freezing compartment.

12. The refrigerator according to claim 11, wherein, in a state of closing the door, the other end of the first cool air collection duct communicates with the inlet of the second cool air collection duct.

13. The refrigerator according to claim 1, further comprising a dispenser provided in the front surface of the door to retrieve the ice from the ice bank.

14. The refrigerator according to claim 1, further comprising a transfer chute connected to the outlet of the transfer case, the pusher being received in the transfer chute, wherein the transfer chute communicates with the ice collection part.

* * * * *